United States Patent [19]

Alexander et al.

[11] 3,946,390

[45] Mar. 23, 1976

[54] RADIO FREQUENCY CONNECTOR SYSTEM FOR PORTABLE RADIOS

[75] Inventors: Norman P. Alexander, Plantation; Bernard Gasparaitis, Fort Lauderdale, both of Fla.

[73] Assignee: Motorola, Inc., Chicago, Ill.

[22] Filed: Apr. 7, 1975

[21] Appl. No.: 565,877

[52] U.S. Cl. ..... 343/702; 200/51.1; 325/23

[51] Int. Cl.[2] ..... H01Q 1/24

[58] Field of Search ..... 200/51.1; 325/21, 22, 23, 325/312; 343/180, 702, 715

[56] References Cited

UNITED STATES PATENTS 2,640,118 5/1953 Werner ..... 200/51.1

*Primary Examiner*—Eli Lieberman

*Attorney, Agent, or Firm*—Donald B. Southard; James W. Gillman

[57] ABSTRACT

The connector system includes a radio mounted receptacle with an integral transfer switch, and a separate connector and cable for interface with external radio frequency (R.F.) circuits, and provides a method of connecting external R.F. circuits to a portable radio and for simultaneously and automatically transferring the internal radio circuits from an integral radio antenna to the receptacle. The integral transfer switch of the receptacle connector includes a movable conductive plunger retained within a conducting sleeve and adapted to slide in an insulator between a first position at which the head of the plunger engages an inturned end of the sleeve, and a second position in which the plunger engages a flexible contact connected to the radio circuit and moves it away from a contact connected to the selfcontained antenna. A connector connected to a coaxial line, which may be connected to external radio frequency signal source, has an outer conductor adapted to connect to the sleeve and an inner conductor which enters the sleeve and engages the plunger to make electrical connection therewith and move the same to the second position. This disconnects the self-contained antenna from the radio circuit and connects the coaxial line thereto. The sleeve, plunger, and inner and outer conductors provide a matched impedance connection from the external source to the radio circuit. The external connector can be manually connected to the radio mounted receptacle connector or automatically coupled thereto when the portable radio is positioned in a carrying housing.

12 Claims, 5 Drawing Figures

RADIO FREQUENCY CONNECTOR SYSTEM FOR PORTABLE RADIOS

BACKGROUND OF THE INVENTION

It is known in portable radios to provide a receptacle on the radio housing for connection of external circuits to the radio. Such a receptacle is described in U.S. Pat. No. 3,812,310, issued May 21, 1974, to Bernard Gasparaitis, and assigned to Motorola, Inc. The plug connector which is used with this receptacle must have a long center conductor so that it can be inserted in the receptacle to operate the contacts thereof and complete the external connection thereto. This is not suitable for use with a very small hand-held radio device which may be used in a compact carrying housing as there is not adequate room for inserting the receptacles. Further, the connector design (long stem) does not lend itself to automatic methods of interconnect.

Further, known connector constructions have caused impedance discontinuities which have resulted in signal loss and caused distortion of the signal. Although prior connector and receptacle structures may perform well at audio frequencies, there is severe mismatch at VHF and UHF radio frequencies.

SUMMARY OF THE INVENTION

It is an object of this invention to provide an improved radio frequency connector for a portable radio device.

Another object of the invention is to provide a miniature connector on a radio which connects an antenna provided with the radio to the radio circuit, and which is adapted to receive a second connector for connecting an external signal source to the radio circuit.

A further object of the invention is to provide a radio mounted receptacle incorporating a switch having normally closed contacts, with a self-contained actuator mechanism for opening the contacts and transferring the radio circuit through the actuator to an external signal source.

A still further object of the invention is to provide a receptacle for receiving a connector connected to a coaxial line, wherein the connectors are constructed to provide a continuous matched impedance therethrough.

Still another object of the invention is to provide a receptacle connector which is adapted to receive a plurality of additional connectors, wherein a minimum of space is required for engaging the connectors, and which can utilize a connector that is automatically engaged with the receptacle.

In practicing the invention, a miniature receptacle connector is provided including a sealed housing with a pair of contacts which are normally engaged to connect a circuit, as to connect the antenna of a portable radio to the radio circuit. The connector includes a conducting plunger which is captured in an insulator and which can be moved against a spring bias to a position to engage one of the contacts and move it away from the other contact. A sleeve nut threaded to a sleeve secured in the housing can be used to mount the receptacle in a wall of the radio housing, and also serves to receive an external connector. The sleeve nut has a shoulder on its outside surface for holding an external connector having resilient sections to make mechanical and electrical connections therebetween, and the external connector can have a center conductor which enters the nut and engages the plunger to move the same to open the circuit through the pair of contacts and complete the circuit from the external connector through the plunger. The receptacle can also be used with a structure which automatically moves an external connector into engagement with the sleeve nut, and which has a center conductor engaging the plunger. In either case, the plunger is biased against the center conductor to make a good electrical connection, and the conductors of the external connector and of the receptacle connector provide a continuous matched line for effective signal coupling.

BRIEF DESCTIPTION OF THE DRAWINGS

DETAILED DESCRIPTION

Figure 1:
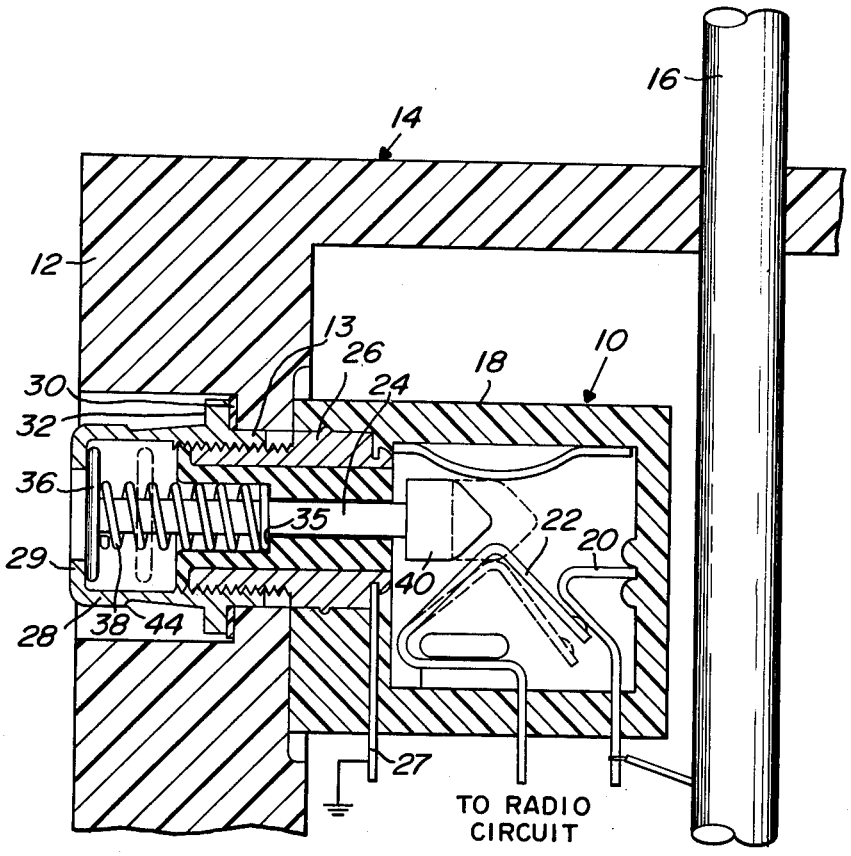
FIG. 1 is a cross-sectional view of the receptacle connector of the invention.

In FIG. 1 there is shown the receptacle connector 10 of the invention as used in a portable radio device, such as a hand-held radio transmitter and receiver 14 which includes an antenna 16 therewith. The connector 10 is mounted on a wall 12 of the radio housing 14, and the antenna 16 is also secured to the radio housing 14. The connector 10 has a housing 18 which forms a sealed enclosure. Within the housing 18 is a fixed contact 20 which is connected to the antenna 16. A resilient movable contact 22, which may be connected to the radio circuit, normally engages the fixed contact 20, as shown by solid lines in FIG. 1. A conducting plunger 24 is mounted for engagement with the resilient contact 22 to move the same to the position shown by dashed lines, in which the resilient contact 22 is open circuited from the fixed contact 20.

Secured to the housing 18 of the receptacle connector 10 is a conducting sleeve 26, which can be embedded in the molded housing. This sleeve 26 passes through an opening 13 in the housing wall 12. A conducting sleeve nut 28 is threaded on the sleeve 26 to hold the receptacle 10 securely to the housing 14. A washer 30 is clamped to a shoulder on the wall 12 by a flange 32 on the nut 28. A recess 15 is provided in the housing wall 12 about the nut 28. The sleeve 26 and the sleeve nut 28 form a continuous outer conductor about the conducting plunger 24.

The sleeve 26 may be connected to a conductor 27 to provide a ground connection for the radio. The plunger 24 is slideably supported in insulator 34 which is positioned within the sleeve 26. The plunger has a head 36 which is engaged by spring 38 which operates against a shoulder 35 in the insulator 34. The spring 38 holds the head 36 of the plunger 24 against the inturned end 29 of the sleeve nut 28. The plunger 24 has an enlarged actuating end 40 which is adapted to engage resilient contact 22. FIG. 1 shows the plunger in its normal position by solid lines, and in this position the actuating end 40 is spaced from contact 22 which engages contact 20 to provide a circuit connection therebetween. When the head 36 of the plunger 24 is moved to the right, as shown by dashed lines in FIG. 1, the actuating end 40 engages resilient contact 22 to make electrical connection threwith, and the connection between contacts 22 and 20 is broken.

Figure 2:
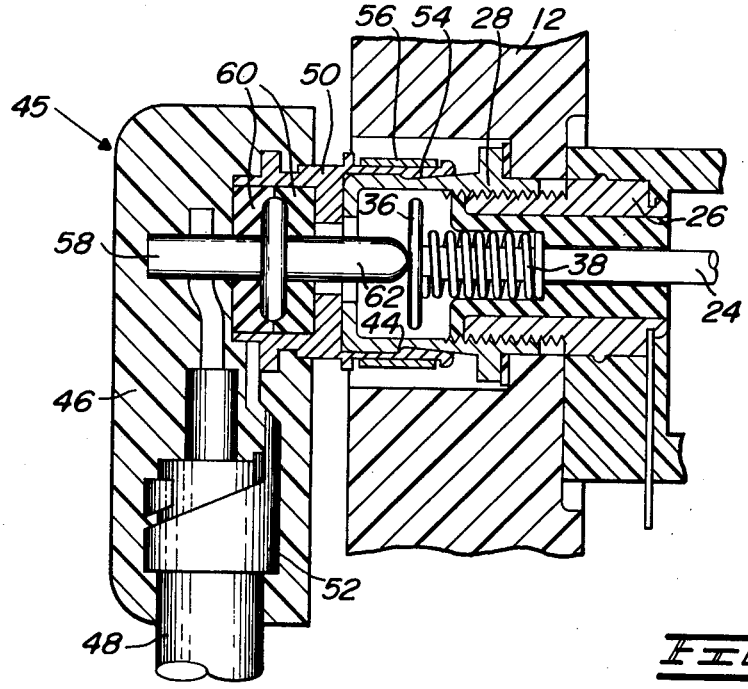
FIG. 2 shows an external connector connected to the receptacle connector.
Figure 3:
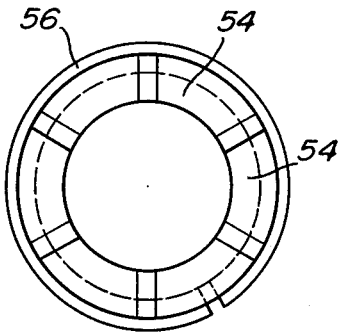
FIG. 3 shows the splined outer conductor of the external connector of FIG. 2.

The receptacle connector 10 of FIG. 1 is adapted to couple to external connectors which may be of different constructions. FIG. 2 shows the connection of one external connector 45 to the receptacle connector 10. The connector 45 has a molded housing 46 to which a coaxial line 48 is secured. An outer conductor 50 is embedded in the housing 46 and is connected by conductor 52 to the sleeve conductor of the coaxial line 48. The conductor 50 has an annular outer portion providing a plurality of resilient splines 54, as shown by FIG. 3. A C-ring 56 is provided about the splines 54 to bias the same inwardly.

FIG. 2 shows that the splines 54 of the outer conductor 50 of the external connector 45 are positioned about the sleeve nut 28 of the receptacle 10. As shown in FIGS. 1 and 2, the sleeve nut 28 has a shoulder 44 formed thereon, and the splines 54 have complimentary shoulders to hold the two parts in secure engagement. The resilience of the splines 54 and the C-ring 56 permit engagement and disengagement of the connector 45 from the receptacle 10. The external connector 45 has an inner conductor 58 which is connected to the center conductor of the coaxial line 48. This has a projection 59 thereon held by insulators 60 positioned within the outer conductor 50. The inner conductor 58 has an end 62 which enters the sleeve nut 28 and engages the head 36 of the plunger 24. This moves the actuating end 40 of the plunger so that it engages resilient contact 22, as shown in FIG. 1.

When the connectors 45 and 10 are engaged, as shown in FIG. 2, the spring 38 holds the end 36 of the plunger 24 firmly against the end 62 of the inner or center conductor 58 to make good electrical connection therebetween. A good electrical connection is also made between outer conductor 50 and sleeve nut 28, which continues through sleeve 26. This provides a coaxial conducting line through the connectors which forms a matched connection so that there is no impedance discontinuity which would cause a loss in signal strength or distortion of the signal.

Figure 4:
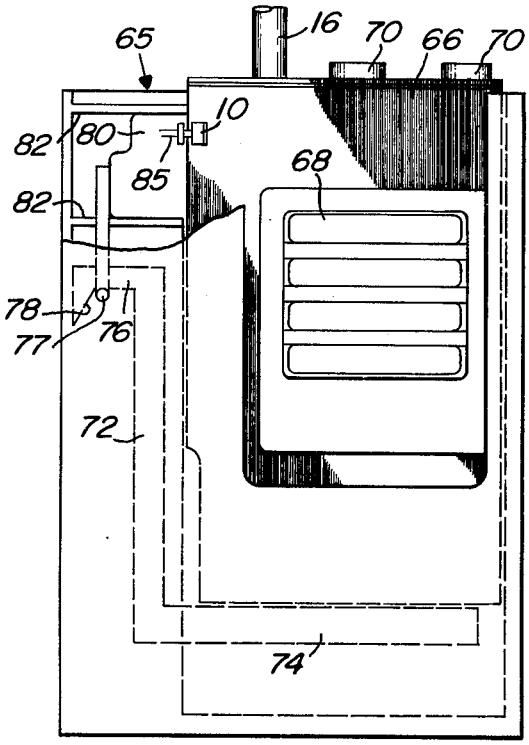
FIG. 4 illustrates the use of the receptacle connector with an external connector in a support for holding a portable radio.
Figure 5:
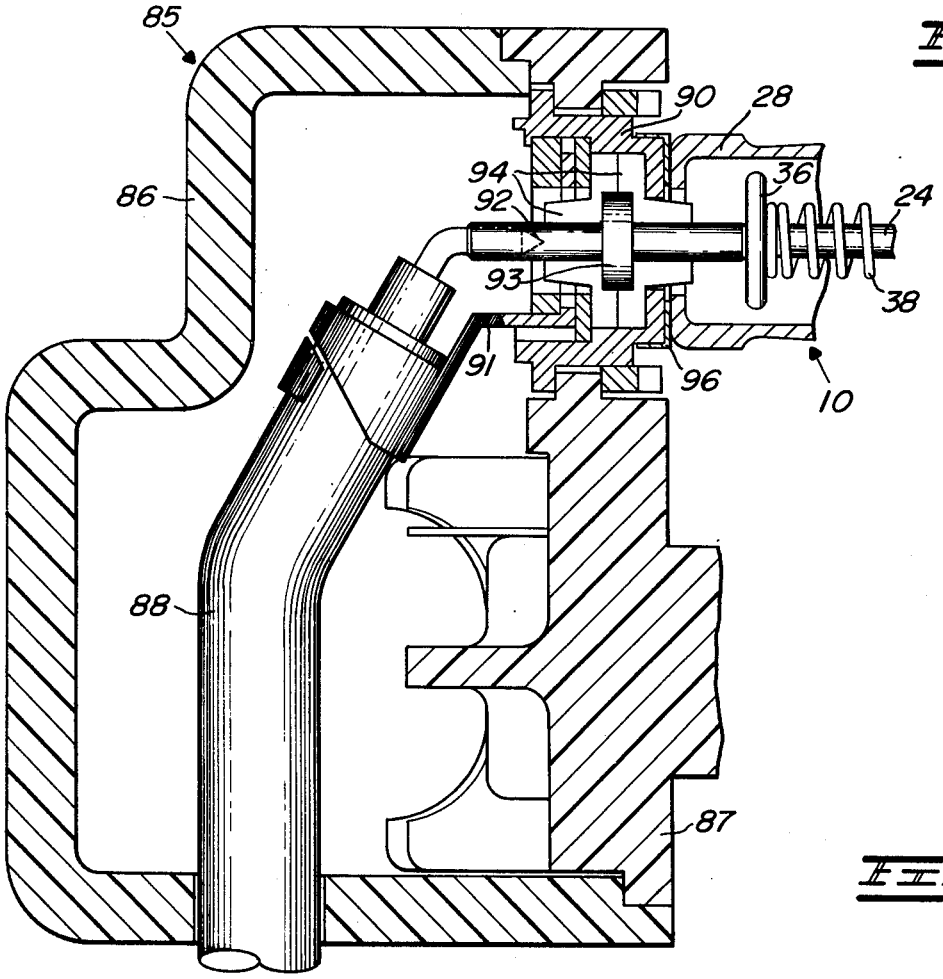
FIG. 5 shows the connectors used in the structure of FIG. 4.

FIGS. 4 and 5 show the use of the receptacle connector of the invention in a different application with a portable radio. It is frequently desired to use a portable radio in a support where a source of radio signals is available. For example, it may be desired to use the radio in a vehicle which has a vehicular antenna providing more effective signal pickup than the antenna of the portable radio.

FIG. 4 shows a support in which a portable radio may be placed. The support 65 has a vertical recess for receiving the portable radio 66, which may be a small hand-held radio transmitter and receiver. FIG. 4 shows schematically that the radio 66 is positioned in the support 65 which has portions engaging the sides of the radio to hold the same in position. The grille 68 at the front of the radio is exposed for transmission of sound from and to the radio. Controls 70 at the top of the radio are also available. The antenna 16 extends at the top of the radio and the receptacle 10 is in the side wall, as in FIG. 1. The support 65 may include a vertical slide structure 72 having a projection 74 extending below the radio 66. When the radio is slid into the support from the top thereof, the radio engages the projection 74 and moves the slide 72 downward. The slide 74 is shown in its downward position in FIG. 4. The slide 72 has a second projection 76 with a cam 77 thereon. This engages a projection 78 on a horizontal slide structure 80. The slide structure 80 may operate along rims 82 provided by the support 65, which form a track for the structure 80. The structure 80 includes a connector 85 which will connect with the receptacle 10, as in shown in FIG. 5. As stated above, the action of the support 65 to automatically move the connector 85 into engagement with jack connector 10 is shown schematically in FIG. 4. This structure can be in accordance with patent Application Ser. No. 511,545, filed Oct. 3, 1974, now U.S. Pat. No. 3,917,372 by George Selinko.

FIG. 5 shows in detail the structure of the external connector 85. This includes a housing formed of parts 86 and 87 into which a coaxial line 88 extends. The connector 85 which couples to the receptacle 10 includes an outer annular conductor 90 connected by conducting clip 91 to the sleeve conductor of the line 88, and an inner or center conductor 92 connected to the center conductor of the line 88. The center conductor 92 has a projection 93, and is supported by insulators 94 within the outer conductor 90. The outer conductor 90 may have a spring washer 96 thereon, as will be described.

FIG. 5 shows the interconnection between connector 85 and the receptacle 10, as is provided by action of the support of FIG. 4. The spring washer 96 is moved into engagement with the sleeve nut 28 and makes good electrical connection therewith. The spring action of the washer 96 takes care of tolerances of the parts and insures a good ground connection. The center conductor 92 enters the sleeve nut 28 and engages the head 36 of the plunger 24 to move the same to the dotted position as shown in FIG. 1. This provides a connection from the center conductor of the line 88 through the center conductor 92 of connector 85 to plunger 24, and to the resilient contact 22 of the receptacle 10. The spring 38 biases the plunger against the conductor 92 to provide a good electrical connection therebetween. The outer conductor 90 of the connector 85 cooperates with the sleeve nut 28 and the conducting sleeve 26 of the jack connector 10 to provide a coaxial conductor with the center conductor 92 and the plunger 24, so that a continuous matched line is provided through the connectors. This will provide effective coupling of signals from coaxial line 88, which may be connected to a vehicular antenna or another radio frequency signal source, to the portable radio.

As has been described, the receptacle connector of the invention can be used with an external connector which is manually connected thereto, as shown by FIG. 2, and with a connector which is automatically brought into engagement, as shown by FIGS. 4 and 5. In either case, a coaxial line is formed through the external connector and the receptacle connector. Also, the connection can be made by only a small movement of the external connector with respect to the receptacle connector. This is to be contrasted with prior structures in which the external connector has a long plug which enters a jack to engage the contacts therein. The receptacle connector and the external connectors of the invention are of relatively simple construction and provide very small units which can be constructed at low cost.

We claim:

1. An antenna connector structure for a portable radio having a self contained antenna, for selectively connecting the radio circuit to the antenna and to external signal supply means, including in combination:

a first contact connected to the antenna, a second flexible contact connected to the radio circuit and normally in engagement with said first contact and capable of being flexed away from said first contact, a conducting plunger biased to a first position spaced from said second contact and movable to a second position engaging said second contact and flexing the same away from said first contact, annular conducting sleeve means spaced about said plunger, and connector means connected to external signal supply means including an outer annular conductor adapted to couple to said conducting sleeve means and an inner conductor adapted to engage said conducting plunger and move the same to said second position, whereby said plunger provides a conducting path from said inner conductor to said second contact to connect the signal supply means to the radio circuit.

2. The connector structure of claim 1 including a housing about said first and second contacts, and wherein said sleeve means includes a first threaded sleeve secured to said housing and a sleeve nut threaded to said first sleeve for mounting said housing.

3. The connector structure of claim 2 including a tubular insulator within said first sleeve, and wherein said plunger is slideably supported in said insulator.

4. The connector structure of claim 3 wherein said plunger has a head on one end thereof within said sleeve nut and an actuating portion on the end opposite said head for engaging said second contact.

5. The connector structure of claim 4 further including a spring acting between said head of said plunger and said insulator for biasing said plunger to said first position.

6. The connector structure of claim 1 wherein said connector means is connected to a coaxial line having a grounded outer conductor connected to said outer annular conductor and a center conductor connected to said inner conductor of said connector means, and wherein said outer annular conductor of said connector means is connected to said conducting sleeve means to ground the same, to provide effective impedance matching from the coaxial line to the radio.

7. The connector structure of claim 1 wherein said annular conducting sleeve means has an outer surface with a shoulder thereon, and said outer annular conductor includes means which engages said shoulder to hold said connector means to said sleeve means.

8. The connector structure of claim 7 wherein said means which engages said shoulder includes a plurality of conducting resilient splines, with a C-ring about said splines to hold the same against said shoulder.

9. The connector structure of claim 7 further including spring means for biasing said plunger to hold the same against said inner conductor to provide a good electrical connection therebetween.

10. The structure of claim 1 wherein said conducting sleeve means is mounted to a portable radio, and further including support means for receiving the portable radio and means slideably supporting said connector means, and wherein said means slideably supporting said connector means moves said outer conductor into engagement with said conducting sleeve means and said inner conductor into engagement with said plunger.

11. The structure of claim 10 wherein said outer conductor includes spring means for making an effective electrical connection to said conducting sleeve means, and including spring means biasing said plunger against said inner conductor to provide an effective electrical connection therebetween.

12. The structure of claim 10 wherein said inner conductor moves said plunger to engage said second contact to flex the same away from said first contact and provide a conducting path from said inner conductor through said plunger and said second contact to the radio circuit.

* * * * *